United States Patent [19]

Windecker

[11] Patent Number: 4,835,975

[45] Date of Patent: Jun. 6, 1989

[54] CRYOGENIC TANK

[76] Inventor: Robert J. Windecker, Box 219, Farm Rd., Belle Grade, Fla. 33430

[21] Appl. No.: 542,979

[22] Filed: Oct. 18, 1983

[51] Int. Cl.[4] ..... F17C 1/00

[52] U.S. Cl. ..... 62/45.1; 220/3; 220/414

[58] Field of Search ..... 62/45; 220/414, 3

[56] References Cited

U.S. PATENT DOCUMENTS

| | | | |
|---|---|---|---|
| 3,137,405 | 6/1964 | Gorcey | 220/3 |
| 3,210,228 | 10/1965 | Bluck | 220/3 |
| 3,341,052 | 9/1967 | Barthel | 220/414 |
| 3,504,820 | 4/1970 | Barthel | 220/3 |
| 3,695,050 | 10/1972 | Bancroft | 62/45 |
| 3,744,271 | 7/1973 | Franklin, Jr. | 62/514 R |
| 3,843,010 | 10/1974 | Morse et al. | 220/3 |
| 3,908,851 | 9/1975 | Jacobs | 220/3 |
| 4,073,400 | 2/1978 | Brook et al. | 220/3 |
| 4,369,894 | 1/1983 | Grover et al. | 220/3 |

OTHER PUBLICATIONS

"Hydrocooling, Nitrogen Atmosphere Combined for Fresher Produce Hauls" from Jan. 1983, Refrigerated Transporter published monthly by Tunnell Publications Inc., P.O. Box 66010, Houston, Tex., 77266, Cover and pp. 16–21.

"The Science of Freshness Perfected", advertising brochure, published late Sep. or early Oct. 1982.

*Primary Examiner*—Ronald C. Capossela

*Attorney, Agent, or Firm*—Wendell Coffee

[57] ABSTRACT

A filament wound pressure vessel or tank includes a thin metal inner liner of 1020 steel wrapped by epoxy-resin-coated fiberglass filament windings. The coefficients of thermal expansion of the windings and the inner liner are approximately equal. The filament windings are clad in a thick layer of polyurethane foam insulation. The foam-insulated cryogenic tanks containing cryogenic fluid are mounted in the front of a refrigerated transport container cooled by the release of the cryogenic fluid coolants thereinto.

4 Claims, 1 Drawing Sheet

CRYOGENIC TANK

BACKGROUND OF THE INVENTION (1) Field of the Invention

This invention relates to filament wound pressure vessels for containing cryogenic fluid for use in refrigerated transport containers.

(2) Description of the Prior Art

Filament wound pressure vessels have a greater capacity to weight ratio than solid wall vessels. This advantage has resulted in the use of such vessels on space craft by NASA. However, the dissimilarity of the inner liner, typically metal, and the outer windings, typically resin-coated fiberglass, caused unequal stresses on the inner liner and winding that resulted in failure of the vessel after repeated use.

Before filing this application, a search was made in the United States Patent and Trademark Office. That search revealed the following United States patents:

| | |
|---|---|
| GORCEY | 3,137,405 |
| BLUCK | 3,210,228 |
| BARTHEL | 3,341,052 |
| BARTHEL | 3,504,820 |
| MORSE ET AL | 3,843,010 |
| JACOBS | 3,908,851 |
| BROOK ET AL | 4,073,400 |
| GROVER ET AL | 4,369,894 |

These patents are specifically referenced because applicant believes the Examiner would consider anything revealed by a search to be relevant and pertinent to the examination of this application.

As applicant understands some of the above cited patents and the state of the prior art, workers in the art have solved some of the problems inherent in filament wound pressure vessels by using certain materials for the inner liner having desired strain characteristics in relation to the fiberglass windings. For example, BROOK ET AL specify certain alloys for the inner liner as possessing the desired strain characteristics of deforming elastically and being resistant to fatigue damage when cyclic strains are applied. GROVER ET AL discloses the elimination of laminate voids in the windings and allowing the metal inner liner to exceed its elastic limit to deform plastically. MORSE ET AL also discloses allowing the metal liner to exceed its elastic strain limit to deform plastically. However, MORSE ET AL provides a winding material having a greater elastic strain limit to withstand cyclic pressurizations and depressurizations although the elastic strain limit of the inner liner is repeatedly exceeded. As applicant understands his disclosure, GORCEY removes strain on the inner liner by pressurizing both sides of the metal liner with a pressurized bladder between the liner and the outer windings.

The references disclosed by the search apparently do not address another problem inherent in the use of filament wound pressure vessels to contain cryogenic fluids. Normally aluminum was used as the liner material to reduce weight. The storage of cryogenic fluids in filament wound pressure vessels can result in vessel temperatures colder than −190° F. As the pressure vessel is cooled from ambient temperatures of about 70° F., down to the cryogenic temperatures, aluminum liners tend to contract more than the winding material, causing the liner to separate from the windings. This separation results in the inner liner alone bearing the full force of the fluid pressure.

Before my invention, some workers in the art accounted for this problem with aluminum inner liners by first prestressing the aluminum liner until it deformed plastically, then winding the aluminum liner with the filament windings. Then as the pressure vessel was cooled to cryogenic temperatures, the filament windings and the inner liner contracted with the inner liner in compression and the windings in tension to keep the inner liner in contact with the windings.

SUMMARY OF THE INVENTION (1) New Function and Surprising Results

My invention obtains the surprising and unusual results of using standard winding methods and a non-prestressed inner liner to construct a cryogenic pressure vessel that does not separate the inner liner from the windings during ambient to cryogenic temperature changes with my novel combination of filament windings and metal liners.

I have solved the problems of winding-liner separation during contraction and expansion by selecting materials for the inner liner and the filament windings that have matching co-efficients of thermal expansion. Low carbon steel, such as 1020 or 1030 steel, has a coefficient of thermal expansion approximately equal to the coefficient of thermal expansion of fiberglass filament windings. Therefore, as liquid nitrogen is placed in the tanks, cooling them from ambient temperature to the cryogenic temperature of the liquid nitrogen, the fiberglass filament windings will contract to about the same extent as the thin steel inner liner. During this cooling, the metal liner is maintained in contact with the fiberglass windings. Pressure loads are exerted on the windings instead of the steel liner.

I prefer to use the filament wound tanks of my invention to contain cryogenic fluid selectively released into the insulated compartment of a refrigerated transport container as coolant. The lighter filament wound tanks save weight, thereby being more efficiently hauled, or permitting the hauling of additional coolant for increased operating periods of the containers.

The filament wound tanks provide additional safety for use on the public highways because a failure of the inner liner of the tank will result in a leakage through the filament windings and foam insulation into the compartment. Failure of a solid wall pressure vessel is ordinarily catastrophic, resulting in an explosion and increased hazards.

Tanks mounted outside the compartment are subjected to widely varying, sometimes high, ambient temperatures. I prefer to mount the tanks inside the insulated compartment to take advantage of the ordinarily lower, more stable compartment temperature. Inside mounted tanks experience heat transfer to the cryogenic fluid in the tanks at lesser rates. Additionally, heat transfer to the cryogenic fluid from the compartment helps to cool the goods therein. The stable compartment conditions may also be used as a basis for efficiently designing the insulation for the tanks as described below.

I prefer to use polyurethane foam insulation for the filament wound tanks used in transport containers. The foam insulation is less expensive and more durable than vacuum linings or other insulation methods, and provides additional benefits to be discussed shortly.

The cryogenic tanks used in any transport container will produce boil off gas resulting from heat transfer from outside the tank to the cryogenic fluid therein. Although some workers in the art allowed this boil off gas to escape to the atmosphere, the boil off gas is preferably used as coolant to the extent practicable. Therefore, the following discussion assumes a use or release of the boil off gas at a particular "usage rate".

Systems for releasing the cryogenic coolant into the compartment ordinarily use a pressurized tank to force the fluid through conduits into the compartment. Therefore, it is necessary that the production of boil off gas due to heat transfer equals or exceeds the usage rate. I prefer to select a foam insulation material and a thickness thereof that will permit heat transfer sufficient to produce the desired rate of boil off gas, without producing excessive boil off and waste of the cryogenic coolant.

For example, during operations of tanks within refrigerated compartments cooled to 33° F. operating temperature, a vacuum lined tank would typically daily boil about 3 percent of the liquid off as boil off gas, due to heat transfer through the tank, whereas a filament wound tank with approximately four inches of polyurethane foam insulation would boil off about 10 percent daily. If the daily usage rate of boil off gas to cool the compartment is 7 percent, it may be seen that the vacuum lined tank would produce insufficient boil off gas to pressurize the system and provide adequate cooling, whereas the filament wound tank with foam insulation would produce adequate boil off gas.

Therefore, the design of appropriate cryogenic tanks, insulation and refrigeration control systems may be more efficiently and reliably accomplished by placing the filament wound cryogenic tanks described above inside a transport container.

Thus it may be seen that the function of the total combination far exceeds the sum of the functions of the individual elements such as steel liners, filaments, resins, etc.

(2) Objects of this Invention

An object of this invention is to contain fluids at cryogenic temperatures and greater than atmospheric pressures.

Further objects are to achieve the above with a device that is sturdy, compact, durable, lightweight, simple, safe, efficient, versatile, ecologically compatible, energy conserving, and reliable, yet inexpensive and easy to manufacture, install, operate and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENT

Figure 1:
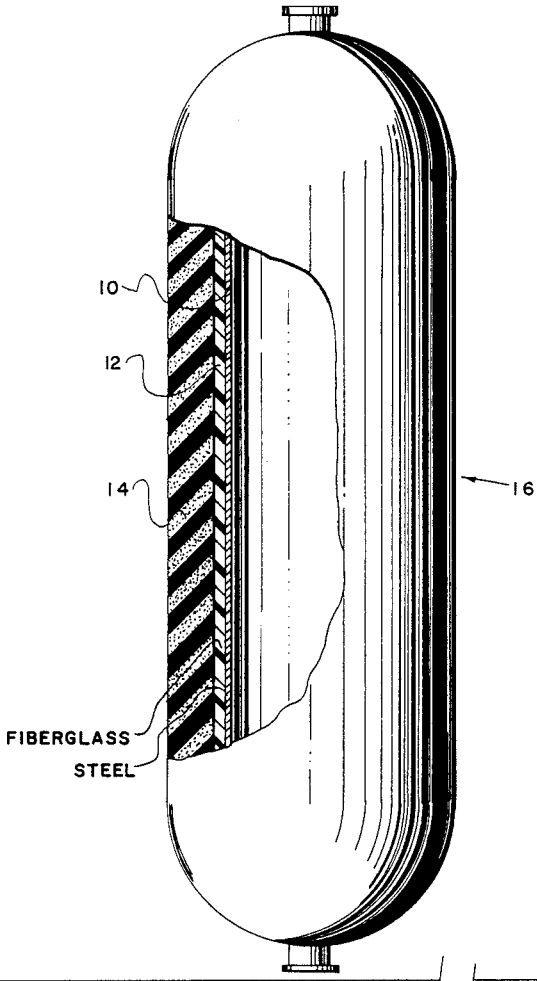
FIG. 1 is an elevational view of a filament wound pressure vessel according to my invention with parts broken away to show detail.

Referring to FIG. 1, a filament wound pressure vessel includes thin metal inner liner 10 wrapped by a plurality of synthetic resin-coated filament windings 12. The filament windings 12 are formed for the preferred embodiment of continuous unidirectional fiberglass filaments bound or coated with an epoxy-resin-coating and wrapped helically and circumferentially about the inner liner 10. The glass to resin ratio is preferentially about 80%.

The inner liner 10 for the preferred embodiment is preferably 1020 low carbon steel about .032 to .040 inches thick. The critical aspect of this steel is its coefficient of thermal expansion, which is approximately equal to the coefficient of thermal expansion of the fiberglass-epoxy windings, or 0.0000055 in/in/°F. Although steels other than the 1020 steel, such as 420 steel, have the desired coefficient of thermal expansion, the 1020 steel was also selected because of its maleability and working properties.

The inner liner is not prestressed beyond its elastic limit prior to winding, nor is the inner liner stressed beyond its elastic limit during normal use. The inner liner is not separated from the fiberglass windings during thermal expansion and contraction, and therefore is not required to bear the pressure loads absorbed by the fiberglass windings.

The filament windings 12 are preferentially covered by a thick layer of polyurethane foam insulation 14. For the preferred embodiment, the fiberglass windings are approximately 3/16 inches thick and the polyurethane foam is approximately 4 inches thick. Of course, it will be understood that variations in the thicknesses of the steel inner liner, filament windings, and polyurethane foam could produce different insulation and pressure capacity characteristics.

Figure 2:
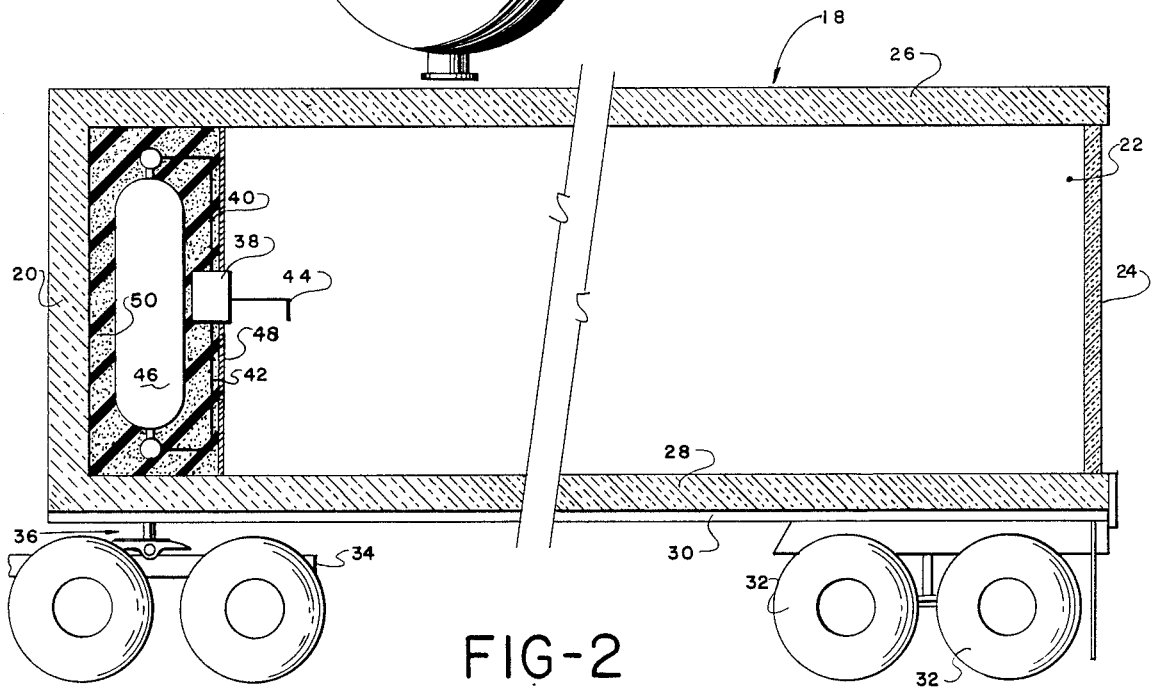
FIG. 2 is a side sectional view of a transport container with a pressure vessel according to my invention and a refrigeration control system somewhat schematically shown mounted therein.

The preferred application of the filament wound pressure vessel according to my invention is with refrigerated transport containers that are cooled by the release of cryogenic fluids into the containers. Therefore, referring to FIG. 2, three pressure vessels or cryogenic tanks 16 according to my invention, with the inner liner 10 and filament windings 12 having matching coefficients of thermal expansion, are mounted in insulated compartment 18 of a transport container. The compartment 18 includes front wall 20, side walls 22, rear doors 24, roof 26 and floor 28.

The transport container includes the compartment 18 mounted on a frame 30 supported by wheels 32 connected to the frame, and tractor 34 (partially shown) connected at fifth wheel 36 to the frame. The tanks 16 are preferably mounted inside the container 18 to minimize heat transfer to the cryogenic fluid, since the temperature inside the container 18 will ordinarily be less than the ambient temperature. I prefer to use several small diameter tanks spread across the front wall to maximize the useable space inside the container 18 and because small tanks are easier to manufacture.

By substituting the filament wound pressure vessels for vacuum lined or solid wall pressure vessels, considerable weight is saved, thereby permitting the carrying of additional nitrogen or other cryogenic fluids, and prolonging the operating period of the container. Additionally, filament wound vessels provide a safety factor over solid metal wall vessels in that if the filament wound pressure vessel fails at the inner liner, the liquid nitrogen will simply leak through the filament windings. However, failure of a solid metal wall pressure vessel ordinarily results in a catastrophic explosion. Therefore, it may be seen that the combination of the filament wound pressure vessels and a transport container using cryogenic fluids as coolants results in a significant improvement of such transport containers.

As described in the Summary of the Invention section above, foam insulated tanks according to my invention have additional advantages when used with control systems that release the boil off gas from tanks or pressure vessels 46 into the insulated compartment 18. Controller 38, with boil off gas line 40 and liquid line 42 connecting the controller to the boil off gas and liquid coolant in the tanks 46, is one form of such control systems. The controller 38 includes the necessary valves, pressure regulators, relays, timers, and conduit to release cryogenic fluid as coolant into the compartment 18.

The preferred controller 38 releases the boil off gas or excess cryogenic fluid coolant vapor, into the compartment over time at a "usage rate". Therefore, the heat transfer through the foam insulation 50, windings 12 and inner liner 10 to the cryogenic liquid must produce boil off gas at least at the usage rate to maintain a maximum system operating pressure needed to force the cryogenic liquid coolant from the tank through the liquid line 42 to the controller 38 and out of distributor 44 into the compartment 18. For example, with the transport container designed to refrigerate and transport fresh vegetables at about 33° F., a four inch thick average polyurethane foam insulation 50 produces a 10 percent per day boil off of cryogenic liquid. The control system for the preferred design has a boil off gas usage rate of about 7 percent per day. Thus, the selected insulation thickness and type will produce adequate boil off gas for system requirements.

The tanks may be individually clad in the foam insulation prior to installation in the transport container, as shown in FIG. 1. I prefer to install the tanks 46, each having the inner liner 10 and the filament windings 12 as described above, at the front of the compartment 18 behind bulkhead 48. Foam insulation 50 is then preferably injected into the space about the tanks 46 enclosed by the front wall 20, the bulkhead 48, and the side walls 22, floor 28, and roof 26 between the bulkhead and front wall, which is segregated by the bulkhead from the rest of the compartment 18. The foam insulation 50 filling the space about the tanks 46 also insulates the lines 40 and 42, and other conduits in the control system, to reduce heat transfer to only that extent required, as described above.

The embodiment shown and described above is only exemplary. I do not claim to have invented all the parts, elements or steps described. Various modifications can be made in the construction, material, arrangement, and operation, and still be within the scope of my invention.

The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawing, the following catalog of elements is provided:

| | |
|---|---|
| 10 inner liner | 32 wheels |
| 12 filament windings | 34 tractor |
| 14 foam insulation | 36 fifth wheel |
| 16 pressure vessels | 38 controller |
| 18 compartment | 40 boil off gas line |
| 20 front wall | 42 liquid line |
| 22 side walls | 44 distributor |
| 24 rear doors | 46 tanks |

-continued

| | |
|---|---|
| 26 roof | 48 bulkhead |
| 28 floor | 50 foam insulation |
| 30 frame | |

SUBJECT MATTER CLAIMED FOR PROTECTION

I claim as my invention:

1. In a transport container having a. an insulated compartment, b. at least one pressure vessel in the compartment, c. cryogenic liquid coolant and boil of gas therefrom contained under greater than ambient pressure within the pressure vessel, and d. a temperature control means fluidly connected to the pressure vessel for releasing the cryogenic liquid coolant and the boil off gas from the pressure vessel into the compartment;

WHEREIN IMPROVEMENT COMPRISES IN COMBINATION WITH THE ABOVE:

e. the pressure vessel having f. a metal inner liner wrapped by g. a plurality of synthetic, resin-coated, filament windings, h. the metal liner having a coefficient of thermal expansion that is substantially equal to the coefficient of thermal expansion of the synthetic filament windings within a temperature range from ambient to cryogenic, i. said pressure vessel being insulated with a thick layer of polyurethane foam enclosing the synthetic filament windings, j. the thickness of said layer being such that the heat transfer through the layer, the synthetic filament windings, and the inner metal liner, to the cryogenic liquid produces boil off gas in greater quantity than is released by the temperature control means into the compartment.

2. In a pressure vessel for containing cryogenic fluids having a. a thin metal inner linear wrapped by b. a plurality of synthetic, resin-coated, filament windings;

WHEREIN THE IMPROVEMENT COMPRISES c. the metal liner having a coefficient of thermal expansion that is substantially equal to the coefficient of thermal expansion of the synthetic filament windings within a temperature range from ambient to cryogenic, d. inner metal liner being formed of 1020 low carbon steel, e. the windings being 80% fiberglass filaments, and f. the 1020 steel having a coefficient of thermal expansion that is substantially equal to the coefficient of thermal expansion of the fiberglass filaments, within a temperature range from ambient to cryogenic.

3. The invention as defined in claim 2 including all of the limitations a. through f. with the addition of the following limitations:

g. the 1020 low carbon steel forming the inner metal liner being about 0.036 inches in thickness, h. said fiberglass filaments wrapped helically and circumferentially about the inner liner, and i. the coefficients of thermal expansion of the steel and the fiberglass filaments being about 0.0000055 in/in/°F. within a temperature range from ambient to cryogenic.

4. In a pressure vessel for containing cryogenic fluids having a. a thin metal inner linear wrapped by b. a plurality of synthetic resin-coated, filament windings;

WHEREIN THE IMPROVEMENT COMPRISES:

c. the metal liner has a coefficient of thermal expansion that is substantially equal to the coefficient of thermal expansion of the synthetic filament windings within a temperature range from ambient to cryogenic.

* * * * *